US006988820B2

(12) United States Patent
Drufva

(10) Patent No.: US 6,988,820 B2
(45) Date of Patent: Jan. 24, 2006

(54) METHOD AND A DEVICE FOR ILLUMINATION

(76) Inventor: Mauri Drufva, Kurjentaival 19, FIN-33100 Tampere (FI)

( * ) Notice: Subject to any disclaimer, the term of this patent is extended or adjusted under 35 U.S.C. 154(b) by 0 days.

(21) Appl. No.: 10/451,257

(22) PCT Filed: Dec. 20, 2001

(86) PCT No.: PCT/FI01/01137

§ 371 (c)(1),
(2), (4) Date: Jun. 20, 2003

(87) PCT Pub. No.: WO02/055926

PCT Pub. Date: Jul. 18, 2002

(65) Prior Publication Data

US 2004/0027669 A1 Feb. 12, 2004

(30) Foreign Application Priority Data

Dec. 21, 2000 (FI) ..... 20002820

(51) Int. Cl.
*F21V 5/00* (2006.01)
*G09F 13/00* (2006.01)

(52) U.S. Cl. ..... 362/559; 362/311; 362/244; 362/555; 40/442; 40/547; 40/560

(58) Field of Classification Search ..... 362/277, 362/290, 292, 317, 354, 342, 555, 234, 235, 362/236, 237, 244, 246, 311, 559, 565; 359/558, 359/566–576; 40/560–562, 442, 463, 547
See application file for complete search history.

(56) References Cited

U.S. PATENT DOCUMENTS 3,215,022 A 11/1965 Orgo (Continued)

FOREIGN PATENT DOCUMENTS

FR 2418102 9/1979

*Primary Examiner*—Alan Cariaso

*Assistant Examiner*—Bertrand Zeade

(74) *Attorney, Agent, or Firm*—Venable LLP; Eric J. Franklin

(57) ABSTRACT

The invention relates to an illumination device for producing an illumination pattern (6) with a variable shape and luminous intensity to a target (5). The illumination device comprises at least partly translucent and light-reflecting optical piece (1), several light sources (3) producing a conical light pattern, fixed in such a manner that the position and angle of the same can be adjusted in relation to each other and/or to the optical piece (1), and an electronic control unit (4) that is electrically coupled to each light source (3) in such a manner that the intensity of the light produced by each light source (3) can be adjusted under the control of the control unit (4). The optical piece (1) is attached in such a manner that the light beams produced by the light sources (3) are arranged to propagate at least partly via the optical piece (1) to the target (5) to be illuminated. The light beams produced by each light source (3) are arranged to form a part of the illumination pattern (6) produced by means of the illumination device, the form of said illumination pattern being substantially independent of the external form of the optical piece. The invention also relates to a method for producing an illumination pattern (6) with a variable shape and luminous intensity to a target. In the method, conical light patterns are produced by means of several light sources (3), of which light patterns at least some are directed via the optical piece (1) to the target (5) to be illuminated. The shape of the illumination pattern (6) produced by means of the method is substantially independent of the external shape of the optical piece.

11 Claims, 1 Drawing Sheet

U.S. PATENT DOCUMENTS 3,366,786 A 1/1968 Delano
4,079,411 A * 3/1978 Engelbrecht et al. ..... 396/305
4,972,305 A 11/1990 Blackburn
6,471,387 B1 * 10/2002 Henshaw et al. ..... 362/555

* cited by examiner

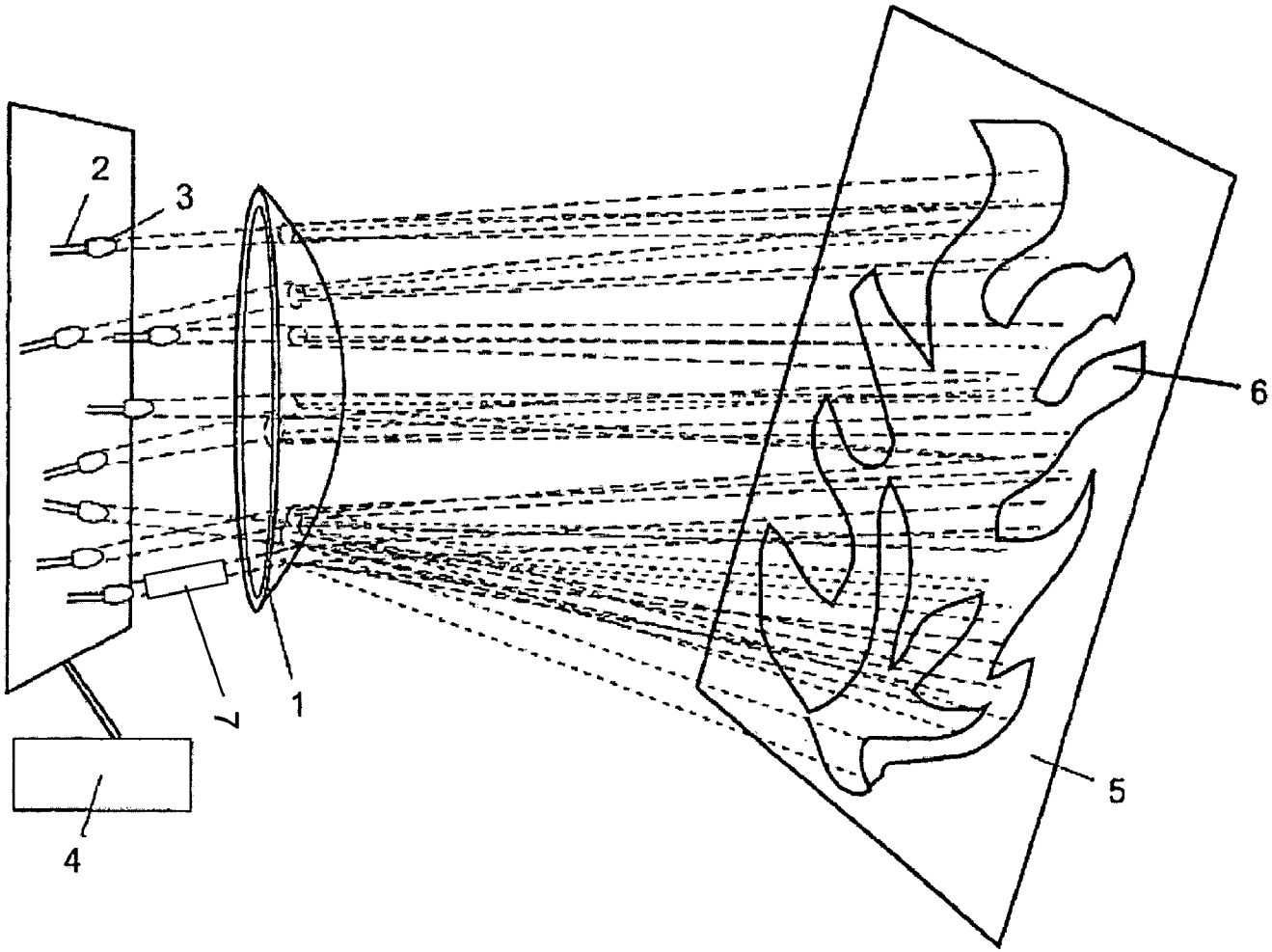
6
5
1
7
3
2
4

METHOD AND A DEVICE FOR ILLUMINATION

The invention relates to a method for illumination and to a device for producing (projecting) an illumination pattern that changes its features in relation to time. The illumination device comprises at least partly translucent and light-reflecting optical piece, several light sources producing a conical light pattern, attached in such a manner that the position and angle of the same can be adjusted in relation to each other and/or to the optical piece, an electronic control unit that is electrically coupled to each light source in such a manner that the intensity of the light produced by each light source can be adjusted under the control of the control unit, and the optical piece is fixed in such a manner that the light beams produced by the light sources are arranged so that they extend at least partly via the optical piece to the target to be illuminated. In the method, to form an illumination pattern with a variable shape and luminous intensity, conical light patterns are formed to a target by means of several light sources, of which light patterns at least some are directed via at least partly translucent and light-reflecting optical piece to the target to be illuminated, and the position and angle of the light sources with respect to each other and/or to the optical piece can be adjusted, and the luminous intensity of at least one light source is adjusted.

It is generally known to implement a light projector, in which the light of the light source propagates through a translucent and/or light-reflecting piece to a target surface, thus producing a light pattern based on the optical properties of said piece. One drawback of said device is the stability of the light pattern.

It is generally known to implement a video projector by means of which it is possible to project moving illumination patterns on the target surface. The drawbacks in the implementation of single light effects are for example the large size of the projector, a structure that is sensitive to ambient conditions and relatively high manufacturing costs.

U.S. Pat. No. 4,972,305 discloses a system for producing a light pattern, in which a special shaped piece is used, such as an artistically designed sculptured piece. In the system a pattern repeating the shapes of the sculptured piece is produced on a screen or a corresponding surface. The shaped piece is a light-reflecting and/or translucent piece which is positioned on a base. Light is directed to the shaped piece at least from a primary light source and at least one secondary light source, wherein the form of the shaped piece is projected on a screen or a corresponding target surface. The colour and intensity of the light produced by the primary light source can be adjusted. Furthermore, the light source and/or shaped piece can be rotated, wherein the light pattern to be produced changes in a corresponding manner. In connection with a light source it is also possible to arrange a piece, by means of which the light beam of the light source is restricted. The light pattern produced by means of the light source according to this publication largely repeats the form of the shaped piece. By changing the properties of different light sources it is possible to affect only the shadowings and colours but not the form of the basic pattern itself.

It is an aim of the present invention to eliminate the above-mentioned drawbacks to a great extent and to enhance the state of the art prevailing in the field and to introduce a method and device for illumination to project light patterns to the target that change their features in relation to time. The invention is based on the idea that conical light is produced by means of several light sources, wherein the produced light beams are directed to an optical piece. In the optical piece different light beams are changed in different ways and the light beams of different light sources are directed to a target surface. Furthermore, at least the luminous intensity of the light beams is varied, wherein temporally changing light patterns are produced on the target surface by means of the method.

The illumination device according to the present invention is primarily characterized in that the light beam produced by each light source is arranged to form a part of the illumination pattern produced by means of the illumination device, the form of which is substantially independent of the external shape of the optical piece.

The method according to the present invention is primarily characterized in that the light beam produced by each light source forms a part of the illumination pattern produced by means of the illumination device, the form of which is substantially independent of the external shape of the optical piece.

Considerable advantages are achieved by the present invention when compared to methods and devices of prior art. The illumination devices according to the invention can be implemented in small size and with a simple structure. The act of changing the light pattern does not necessarily require the changing of the optical piece, especially if the different light patterns possibly implemented with the illumination device have been taken into account when designing the optical piece. Furthermore, the manufacture of the illumination devices according to the invention is economical. Moreover, as such illumination devices are small in size, it is easier to position them when compared to devices of prior art. Furthermore in devices according to a preferred embodiment of the invention, heating up is less evident, because LED light sources can be used as light sources. In-the method according to a second preferred embodiment of the invention, optical fibres are used for conducting light produced by light sources, wherein the light sources can be positioned more freely and the light sources can be better protected against ambient conditions, such as humidity. Thus, the light pattern produced by means of the light sources can be placed even in difficult ambient conditions.

In the following, the invention will be described in more detail with reference to the appended drawing, which describes a device based on the illumination method according to a preferred embodiment of the invention.

The device comprises several light sources 3 that produce conical light and at least one optical piece 1. The light beam produced by at least one light source is directed to the optical piece 1 directly or via photoconductor, such as an optical fibre 7. Thus, at least some of the light beams of the light sources 3 directed to the optical piece 1 change their direction before the light beams propagate to the target surface 5. The intensity of the light produced by the light sources 3 is controlled by means of an electronic control unit 4. In such an electronic control unit 4 it is possible to implement an application program or the like by means of which each light source 3 can be controlled and temporally changing light patterns can be produced on the target surface 5. One advantageous implementation alternative for the control of the luminous intensities of the light sources is pulse width modulation (PWM), but other control methods can also be used in a manner known as such.

The light sources 3 can be attached for example on a planar installation base, or the like in such a manner that the placement and/or direction of at least one light source can be changed. The energy for the light source is conveyed via conductors 2, which can be for example elastic conductors.

In the implementation of the present invention, the central aspect is the implementation of the optical piece 1 and the placement of the light sources 3 in such a manner that the desired light pattern can be produced. Recently three-dimensional design programs have been developed by means of which it is possible to design pieces with varying shapes and to simulate the features of the piece, for example the direction of the light sources. The structural planning of the device based on the illumination method according to the invention can thus be implemented with such modern computer-assisted design and simulation tools intended for three-dimensional designing. The designing takes place by positioning virtual light sources and a virtual optical piece suitable for shaping of the light beams of the light sources in the three-dimensional design space of the 3D tool. By changing the position and luminous intensity of the light sources as well as the form and other features of the optical piece it is possible to design and simulate a structure by means of which it is possible to produce the desired light effect. The documentation necessary for the implementation of the structure of the device is attained as a result of the designing work. For example the optical piece belonging to the structure can be manufactured of a selected material on the basis of the documentation. If the material is glass, it is possible to implement a cast mould necessary in the manufacture on the basis of the design documentation.

In the illumination device according to the invention, the external shape of the optical piece 1 does not necessarily have to resemble the illumination pattern produced by means of the illumination device, but the desired illumination pattern is produced for example by affecting the travel direction of the rays of light by means of the optical piece 1. In the illumination device according to the invention, the basic form of the illumination pattern is not produced by means of the optical piece 1, but it is produced in such a manner that the final shape of the illumination pattern is composed of a combination of several light beams produced by the light source 3, in other words of illumination areas formed of separate light beams. The shape, colour and inner intensity distribution of these illumination areas can be modified by means of one or more optical pieces 1 by directing the light beams through one or more optical pieces 1. Thus, the desired illumination pattern is in a way painted by means of light beams. Each light beam can be considered to correspond to one colour of a brushstroke in a painting. The optical piece 1 can be considered to correspond to a brush in an artist's hand, which brings the colour into the correct form and location in the painting. Furthermore, by means of the illumination device according to the invention it is possible to make the produced illumination pattern vivid by controlling the intensity of the light patterns as a function of time during the operation.

In the illumination device a separate control unit 4 is also necessary, by means of which the control functions of the device are implemented to produce a light effect. The control unit typically consists of a microprocessor or a microcontroller and peripheral components (not shown) as well as of a power supply device. This electronic control unit 4 preferably contains a program controlling the function of the illumination device. According to the program the control unit can control the luminous intensity of each light source 3 individually. Furthermore, the control unit 4 can control other auxiliary functions of the device, such as the moving of a structural part of the device, such as the optical piece 1 or one or more light sources 3 in relation to the other structural parts. There are tools for developing the program of the control unit, by means of which it is possible to implement complex software. It is obvious that in some applications it is possible to group the light sources, wherein the control unit 4 is utilized to control such groups made of light sources 3 instead of or in addition to single light sources.

The light effect implemented by means of the device according to the invention is produced as a combined effect of the structure of the device and the control functions of the electronic control unit 4 of the illumination device.

The illumination method according to the present invention can be applied for example for mood lighting by implementing a device based on the method, by means of which for example a light effect imitating a campfire can be attained. This embodiment utilizes an illumination pattern with the shape of a narrow cone that is characteristic to the light source 3, in such a manner that each single light beam is directed obliquely through the optical piece 1 to the target surface 5, in which several elongated light patterns with a flame-like shape are formed, which together produce an illumination pattern 6 imitating a campfire. The electronic control unit 4 is utilized to control the luminous intensity of the light sources 3 as a function of time in such a manner that the shape of the illumination pattern 6 and the luminous intensities at different parts of the flame pattern vary, thereby imitating a real campfire.

A second embodiment is a device based on the illumination method according to the invention, by means of which a light effect resembling aurora borealis can be produced. The structure of the device is similar to the structure of the device according to the preceding example. The differences exist primarily in the placement and colours of the light sources 3 and in the shape and placement of the optical piece 1, as well as in the control program of the control unit 4.

In the implementation of the present invention, a basic idea is the utilization of the possibilities of modern technology to design and practically implement an illumination device of the above-mentioned kind. The basic structure of the device according to the invention is quite simple, but it requires quite complex placement of the different structural parts and control of the optical properties in order to attain the desired light effect, the implementation of which has not been possible or reasonable in practice without modern design and simulation tools. Furthermore, as for the function of the device, the central aspect is the capability to control the image pattern produced by the device in a controlled manner.

In the device according to a preferred embodiment of the invention, the light sources 3 are LED components.

Alternative embodiments of the devices implemented on the basis of the illumination method according to the invention are also described in claims 2 to 12.

It is obvious that the invention is not limited solely to the above-presented embodiments, but it can be modified within the scope of the appended claims.

What is claimed is:

1. An illumination device for producing an illumination pattern with a variable shape and luminous intensity to a target, which device comprises:

an optical piece that is at least partly translucent and light refracting;

several light sources each producing a conical light pattern directed to the optical piece and at least partially propagating at least partially via the optical piece to the target, a position and angle of the light sources being adjustable in relation to at least one of each other and the optical piece, the light beam produced by each light source forming only a part of the illumination pattern produced by the illumination device, the shape of the illumination pattern is independent of the external shape of any optical piece to which the light sources are directed such that the illumination pattern does not resemble the external shape of the optical piece; and an electronic control unit that is electrically coupled to each light source in such a manner that the intensity of the light produced by each light source can be adjusted under the control of the control unit, the control unit comprising a control program operative to control the intensity of the light produced by each light source and to make the produced illumination pattern vivid with respect to time.

2. The illumination device according to claim 1, wherein it is fixedly coupled as a part of a generally known illuminator.

3. The illumination device according to claim 2, wherein a structural part separating the illumination part is coupled to the device.

4. The illumination device according to claim 1, wherein the light sources are LED components.

5. The illumination device according to claim 1, wherein the electronic control unit is implemented by microprocessor technology or digital circuit technology and wherein pulse width modulation is arranged to be used in the control of the luminous intensity of the light sources.

6. The illumination device according to claim 1, wherein the optical piece is made of glass or plastic, and it is intentionally shaped into an irregular form, deviating substantially from a rectangular prism or ball segment or rotation paraboloid or another corresponding regular geometric piece.

7. The illumination device according to claim 1, wherein there are several optical pieces located successively and/or next to each other.

8. The illumination device according to claim 1, wherein at least one of the light-producing light sources is replaced with a combination of a light source and an optical fiber in such a manner that the first end of the optical fiber is optically connected to a light-producing light source wherein the second end of the optical fiber is arranged to produce a light beam directed to the optical piece.

9. The illumination device according to claim 1, wherein the target surface is a fixed part of the device.

10. The illumination device according to claim 1, wherein at least one of said structural parts are arranged to be coupled in such a manner that the position of the same in relation to the rest of the device is arranged to be changed during the function of the device.

11. A method for forming an illumination pattern with a variable shape and luminous intensity to a target, the method comprising:

producing conical light patterns with a plurality of several light sources;

directing at least a portion of the light patterns to an at least partly translucent and light-refracting optical piece;

propagating the at least a portion of the light patterns at least partly via the optical piece to the target to be illuminated, the light beam produced by each light source propagates via the same optical piece, the light beam produced by each light source forming only a part of the illumination pattern produced by means of the illumination device, the shape of the illumination pattern being independent of the external shape of any optical piece to which the light sources are directed such that the illumination pattern does not resemble the external shape of the optical piece; and controlling the intensity of the light produced by each light source with a control program to make the illumination pattern vivid as a function of time.

* * * * *